United States Patent [19]

Arashi

[11] Patent Number: 4,541,255

[45] Date of Patent: Sep. 17, 1985

[54] JIGGER DYEING APPARATUS

[75] Inventor: Masahiro Arashi, Komatsu, Japan

[73] Assignee: Onomori Iron Works Co., Ltd., Ishikawa, Japan

[21] Appl. No.: 580,327

[22] Filed: Feb. 15, 1984

[30] Foreign Application Priority Data

Feb. 16, 1983 [JP] Japan ..... 58-020014[U]

[51] Int. Cl.[4] ..... D06B 3/32

[52] U.S. Cl. ..... 68/22 R; 68/180; 68/184

[58] Field of Search ..... 68/22 R, 158, 175, 180, 68/181 R, 184, 207, 208; 134/122 R, 122 P; 118/419, 429

[56] References Cited

U.S. PATENT DOCUMENTS

| | | | |
|---|---|---|---|
| 1,096,845 | 5/1914 | Landsberger | 68/22 R X |
| 1,700,925 | 2/1929 | Dezurik | 68/181 R |
| 2,764,009 | 9/1956 | Sarti | 68/22 R X |
| 2,936,733 | 5/1960 | Duggins | 118/419 X |
| 3,718,012 | 2/1973 | Vinas | 68/184 X |
| 3,863,600 | 2/1975 | Van Regenmortel | 118/419 |
| 4,176,532 | 12/1979 | Mishima et al. | 68/181 R X |

FOREIGN PATENT DOCUMENTS

| | | | |
|---|---|---|---|
| 598028 | 9/1959 | Italy | 68/175 |
| 1107035 | 3/1968 | United Kingdom | 68/180 |

*Primary Examiner*—Philip R. Coe

*Attorney, Agent, or Firm*—Armstrong, Nikaido, Marmelstein & Kubovcik

[57] ABSTRACT

A jigger dyeing apparatus comprising a liquid-draining device which is arranged in a travel passage of a spread textile fabric to be dyed between winding rolls and dyeing rolls so that a dyeing solution is squeezed out on the entire surface of the fabric uniformly with respect to the weft direction of the fabric, and a dyeing solution circulating system and a dyeing box, which are arranged so that while the fabric is being dipped in the dyeing solution, the dye concentration in the dyeing solution falling in contact with the fabric is always kept uniform in respective portions of the fabric. The problem of listing involved in conventional jigger dyeing apparatus can be completely solved by using the present jigger dyeing apparatus.

10 Claims, 4 Drawing Figures

JIGGER DYEING APPARATUS

BACKGROUND OF THE INVENTION

1. Field of the Invention

The present invention relates to an improvement in a jigger dyeing apparatus.

2. Description of the Prior Art

In the known jigger dyeing apparatus, a travel passage of a spread textile fabric to be dyed is defined by two winding rolls arranged in parallel in a can and several movable rolls arranged below the winding rolls in parallel thereto, and the lowermost roll is immersed in a dyeing solution contained in a dyeing box. In the dyeing process using this jigger dyeing apparatus, a web of textile fabric to be dyed, which is wound on one winding roll (hereinafter referred to as "winding roll A") is unwound and passed through the above-mentioned travel passage, and the fabric is then wound on the other winding roll (hereinafter referred to as "winding roll B"). This operation is continued until the fabric is entirely wound on the winding roll B. Then, the fabric wound on the roll B is wound in the reverse direction, and the fabric is entirely wound on the winding roll A again through the travel passage. This travel of the fabric between both the winding rolls is repeated several times, whereby the fabric is subjected to winding and dipping repeatedly and is dyed. The serious defect of this dyeing process is that the central portion of the fabric with respect to the weft direction is dyed more thinly than both the selvage portions. That is, so-called listing is caused. Various methods have been adopted for preventing occurrence of listing, but no good results have been obtained.

We made research with a view to solving this problem of listing in the jigger dyeing process, and it was found that listing is caused for the following two reasons.

In the first place, between the central portion and both the selvage portions of a spread fabric, wound on the winding rolls, with respect to the weft direction, there are differences of the amount of the dyeing solution impregnated in the fabric and the amount of the dyeing solution present between the layers of the wound fabric. In short, the difference of the retention quantity of the dyeing solution is one cause of listing. When the fabric dipped in the dyeing solution is wound on the winding roll, a part of the dyeing solution taken out together with the fabric is dropped into the dyeing box by squeezing, and simultaneously, the remaining dyeing solution flows toward both the selvage portions and is left in the selvage portions. Accordingly, the retention quantity of the dyeing solution in the selvage portions becomes larger than in the central portion, with the result that the central portion having a smaller retention quantity of the dyeing solution is dyed more thinly than the selvage portions having a larger retention quantity of the dyeing solution.

In the second place, when the fabric is dipped in the dyeing solution, the dye concentration in the dye solution that comes in contact with the fabric differs between the central portion and both the selvage portions with respect to the weft direction. This difference of the dye concentration is another cause of listing. The dyeing solution left in both the selvage portions of the fabric in the dyeing box with respect to the weft direction does not permeate through the fabric even after the dye has been absorbed in the fabric, and the residual dyeing solution is replaced in succession with the fresh dyeing solution from the outer side, with the result that the dye concentration is hardly reduced. On the other hand, the dyeing solution present in the central portion is hardly replaced by the fresh dyeing solution, and therefore, the dye concentration is graudally reduced and the dye concentration is always lower than in the dyeing solution present in both the selvage portions. Accordingly, the central portion of the fabric is dyed more thinly than the selvage portions.

We found that listing is caused mainly for the above-mentioned two reasons, and we have now completed the present invention.

SUMMARY OF THE INVENTION

It is a primary object of the present invention to solve the above-mentioned problem and provide a jigger dyeing apparatus in which the retention quantity of a dyeing solution is made uniform in respective portions of a textile fabric to be dyed and the difference of the dye concentration in the dyeing solution in which the fabric is dipped is eliminated with respect to the weft direction of the fabric, whereby occurrence of listing is prevented and such a uniform dyeing as not attainable by the conventional apparatus can be obtained.

A first characteristic feature of the present invention is that in the known jigger dyeing apparatus, a liquid-draining device is arranged in the travel passage of a spread textile fabric to be dyed, which extends below the above-mentioned two winding rolls, so that a dyeing solution on the entire surface of the fabric is squeezed out uniformly with respect to the weft direction of the fabric, whereby the retention quantity of the dyeing solution is made uniform in respective portions of the fabric.

A second characteristic feature of the present invention is that in the known jigger dyeing apparatus, a dyeing solution circulating system is arranged so that when the fabric is dipped in the dyeing solution, the dye concentration in the dyeing solution which comes in contact with the fabric is always kept uniform, and a dyeing box which is a dyeing solution holding box having a small volume is additionally arranged independently from a conventional dyeing solution box so that by dyeing the fabric in this dyeing box, the difference of the dye concentration in the dyeing solution with respect to the weft direction of the fabric is eliminated.

DESCRIPTION OF THE PREFERRED EMBODIMENTS

The present invention will now be described in detail with reference to an embodiment illustrated in the accompanying drawings.

Figure 1:
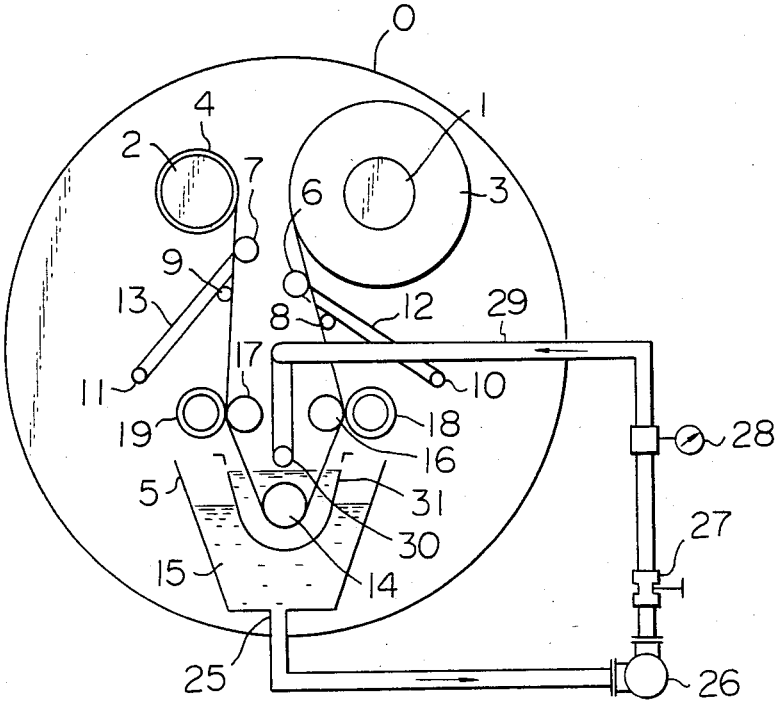
FIG. 1 is a view diagrammatically illustrating an embodiment of the apparatus of the present invention.

In FIG. 1, reference numeral 1 represents a winding roll A arranged in the upper portion of a can 0 having a closed structure, reference numeral 2 represents a winding roll B arranged in parallel to the winding roll A, reference numeral 3 represents a spread textile fabric to be dyed, which is wound on the winding roll A, reference numeral 4 represents the fabric wound on the winding roll B, reference numeral 5 represents a dyeing solution box where a dyeing solution is held, each of reference numerals 6 and 7 represents a guide roll arranged on a travel passage of the spread fabric, each of reference numerals 8 and 9 represents a fabric spreading bar arranged on the travel passage, each of reference numerals 10 and 11 represents a balance arm supporting shaft, each of reference numerals 12 and 13 represents a balance arm, and reference numeral 14 represents a dyeing roll immersed in a dyeing solution 15.

Figure 2:
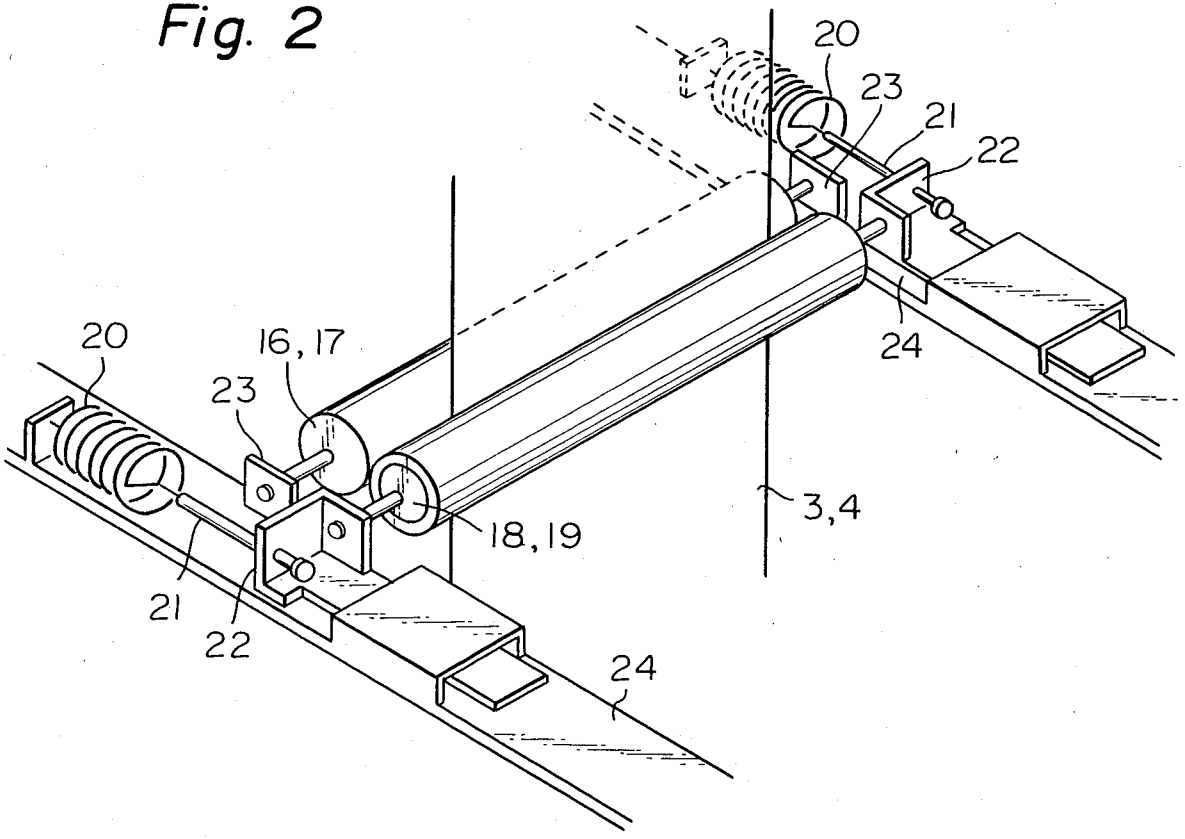
FIG. 2 is an enlarged perspective view showing an example of the liquid-draining device.

In the apparatus of the present invention, according to the above-mentioned first characteristic feature, stationary rolls 16 and 17, squeezing rolls 18 and 19 and pressing devices 20, 21, 22, 23 and 24 as shown in FIG. 2 are arranged.

The above-mentioned two kinds of rollers are arranged in parallel above the dyeing roll and below the fabric spreading bars so that the stationary rolls 16 and 17 are located on the inner side of the travel passage of the fabric and the squeezing rolls 18 and 19 are located on the outer side of the travel passage, and that the rollers 16, 17, 18 and 19 are in parallel to the surface of the fabric and intersect the travelling direction of the fabric at right angles. The length of these rollers is adjusted so that liquid draining can be performed throughout the weft direction of the fabric. The squeezing rolls are arranged to uniformly squeeze out the dyeing solution brought up by the fabric. In the present embodiment, movable rollers having the surface coated with a soft rubbery material are used as the squeezing rolls.

The stationary rolls correspond to the squeezing rolls and they are arranged to effect positioning of the fabric for squeezing the fabric in a stable state. In the present embodiment, movable rolls of stainless steel which are straight and have a sufficient strength are used as the stationary rollers.

The pressing devices are arranged in the shaft portions of the squeezing rolls, and each pressing device comprises a coil spring 20, a squeezing pressure adjusting metal piece 21, a moving bearing 22, a stationary bearing 23 and a rail 24. The force generated by the coil spring is transmitted to the squeezing roll through the squeezing pressure adjusting metal piece and moving bearings to grip and insert the fabric between the squeezing roll and the stationary roll and to always uniformly squeeze the fabric. The squeezing pressure can be adjusted by moving the squeezing pressure adjusting metal piece in the longitudinal direction thereof, whereby an optimum squeezing pressure can be obtained.

An example of the liquid-draining device has been explained. The liquid-draining device is not limited to one having the above-mentioned structure but any structure capable of attaining the objects of the present invention can be adopted.

In the apparatus of the present invention, of the dyeing solution being wound on the winding roll together with the fabric in the jigger dyeing process, only the portion necessary for uniformly dyeing the fabric is left but the remaining portion is entirely squeezed out. As the fabric is wound on the winding roll, the retention quantity of the dyeing solution is gradually increased toward both the selvage portions in the conventional apparatus. In the apparatus of the present invention, however, the excessive dyeing solution is squeezed out from the fabric, and therefore, the fabric is wound on the winding roll in the state where the retention quantity of the dyeing solution is kept uniform, with the result that the difference of the retention quantity of the dyeing solution, one main cause of listing, is eliminated.

In the apparatus illustrated in the accompanying drawings, according to the above-mentioned second characteristic feature of the present invention, there are arranged a dyeing solution circulating system and a dyeing box 31, and the dyeing solution circulating system comprises a sucking opening 25 opened to the inner bottom portion of the dyeing solution box, a pump 26, a flow rate adjusting valve 27, a flow meter 28, a feed pipe 29 and an extruding pipe 30 having an opening for jetting the dyeing solution.

In the apparatus of the present invention, the dyeing solution 15 is sucked from the sucking opening 25 of the dyeing solution box by the pump 26, guided to the extruding pipe 30 through the flow rate adjusting valve 27, flow meter 28 and feed pipe 29 and jetted from the opening of the extruding pipe 29. Then, the dyeing solution wets the fabric in the dyeing box 31 and is then returned to the dyeing solution box 5. These operations are repeated continuously. The amount circulated of the dyeing solution is variable by the flow rate adjusting valve, and the flow rate of the dyeing solution can be precisely indicated on the flow meter.

The extruding pipe 30 is arranged 5 to 150 mm, preferably 10 to 20 mm, above the dyeing roll in the central portion of the dyeing roll with respect to the longitudinal direction thereof in parallel to the travel passage of the fabric. The extruding pipe 30 has a bisymmetrical T-figured shape and has such a structure that the dyeing solution fed from the feed pipe 29 is caused to flow uniformly with respect to the weft direction of the fabric. The opening of the extruding pipe 30 is directed to the dyeing roll, and the dyeing solution jetted from the opening does not directly impinge against the fabric, but the dyeing solution once impinges against the dyeing roll or the dyeing solution, whereby the flow rate of the jetted dyeing solution is reduced and lost and the dyeing solution is moved at the flow rate possessed by the total flow while having contact with the fabric.

Figure 3:
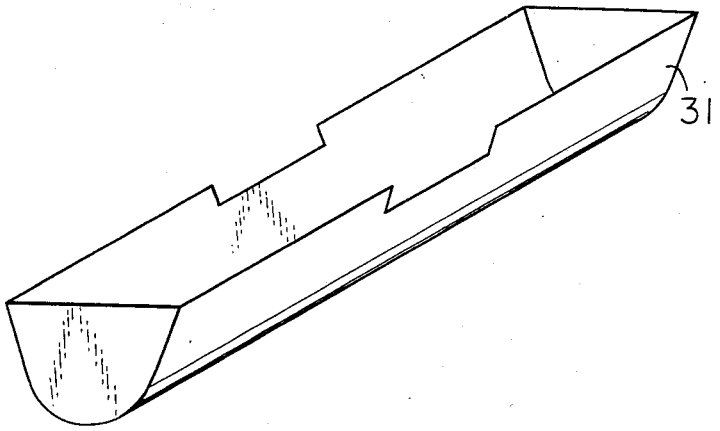
FIG. 3 is a perspective view showing an example of the shape of the dyeing box.
Figure 4:
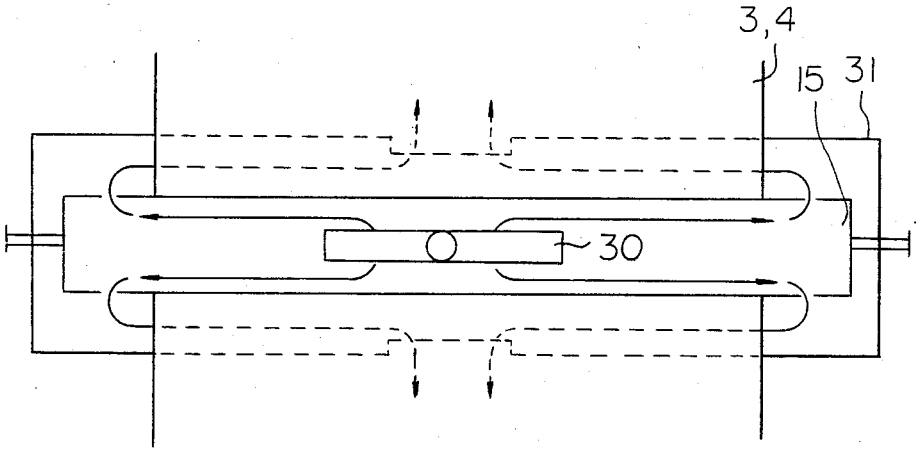
FIG. 4 is a view of the dyeing box, seen from right above, which illustrates the flow of the dyeing solution in the dyeing box.

The dyeing box 31 is located on the inner side of the dyeing solution box 5 and is arranged so that the dyeing roll 14 is entirely immersed in the dyeing solution. The shape of the dyeing box 31 in the present embodiment is shown in FIG. 3. The dyeing box is disposed to perform uniformly and promptly the exchange between the dyeing solution left in the box after the dye has been taken out by the fabric and the fresh dyeing solution fed by the pump. The shape of the dyeing box is not particularly critical, so far as the volume of the dyeing box is appropriate to the quantity of the dyeing solution fed from the pump and the dyeing box has such a structure that a liquid-stagnant portion is hardly formed. In the dyeing box, notches for overflowing the dyeing solution are formed on both the surfaces of the central portion with respect to the longitudinal direction of the dyeing box. As shown in FIG. 4, the notches are disposed so as to guide the dyeing solution jetted from the extruding pipe located at the central portion of the inner side of the fabric to the outside of the fabric through both the selvage portions of the fabric and overflow the dyeing solution into the dyeing solution box.

By using the above-mentioned apparatus, the dye concentration in the dyeing solution in which a textile fabric to be dyed is dipped is always kept uniform in the weft direction of the fabric, and the difference of the dye concentration in the dyeing solution, one cause of occurrence of listing, is eliminated.

When the dyeing operation is carried out by using the jigger dyeing apparatus of the present invention, the problem of listing involved in the conventional apparatus can be solved completely.

I claim:

1. A jigger dyeing apparatus comprising:

a dyeing solution box having a quantity of dyeing solution therein;

a dyeing box positioned within said dyeing solution box said dyeing box having outer edges in overflow relationship with said dyeing solution box;

a dyeing roll within said dyeing box;

a pair of winding rolls positioned above said dyeing box so that a web of fabric on one of said winding rolls may be unwound from said winding roll to travel downwardly through said dyeing box to pass under said dyeing roll and upwardly to be sound on the other of said winding rolls;

an extruding pipe located above said dyeing roll; and a dyeing solution circulating system arranged to take dyeing solution from said dyeing solution box and circulate said dyeing solution to said extruding pipe to be extruded downwardly toward said dyeing roll, whereby dyeing solution will fill said dyeing box and be caused to flow along said dyeing roll and said fabric web to said outer edges of said dyeing box and overflow said dyeing box into said dyeing solution box to be recirculated, thereby maintaining a uniform concentration of dye in said dyeing solution circulating through said dyeing box in contact with said fabric.

2. A jigger dyeing apparatus as claimed in claim 1 further comprising a liquid-draining device arranged in the travel passage of said fabric web for removing excess dyeing solution from said fabric.

3. A jigger dyeing apparatus as claimed in claim 2 wherein said liquid-draining device comprises a pair of squeezing rolls arranged to uniformly squeeze out dyeing solution brought up by said fabric.

4. A jigger dyeing apparatus as claimed in claim 3 wherein at least one of said squeezing rolls has a surface coated with a soft rubbery material.

5. A jigger dyeing apparatus as claimed in claim 1 wherein said dyeing box has a volume smaller than said dyeing solution box and has a substantially rectangular open top with overflow notches formed in the longitudinal sides thereof for overflowing said dyeing solution, whereby said circulated dyeing solution is caused to flow above said dyeing roll from the center outwardly around the outer edges of said fabric web and along said longitudinal sides to said overflow notches, thereby eliminating differences of dye concentration in dyeing solution through which said fabric travels.

6. A jigger dyeing apparatus as claimed in claim 5 wherein said dyeing solution circulating system comprises a pump, a feed pipe, a flow rate adjusting valve, a flow meter, and said extruding pipe, and wherein said extruding pipe is T-shaped and has an opening directing said dyeing solution to impinge against said dyeing roll.

7. A jigger dyeing apparatus as claimed in claim 1 wherein said dyeing solution circulating system comprises a pump, a feed pipe, and said extruding pipe.

8. A jigger dyeing apparatus as claimed in claim 7 wherein said extruding pipe is positioned above said dyeing roll at the central portion of said dyeing box.

9. A jigger dyeing apparatus as claimed in claim 8 wherein said extruding pipe is T-shaped and has an opening directing said dyeing solution to impinge against said dyeing roll.

10. A jigger dyeing apparatus as claimed in claim 9 wherein said dyeing solution circulating system further comprises a flow rate adjusting valve and a flow meter.

* * * * *